US010301001B2

(12) United States Patent
Korupp et al.

(10) Patent No.: US 10,301,001 B2
(45) Date of Patent: May 28, 2019

(54) PUMP DEVICE

(75) Inventors: Sascha Korupp, Asslar-Werdorf (DE); Michael Kahsnitz, Wetzlar (DE)

(73) Assignee: Herborner Pumpenfabrik J.H. Hoffman GmbH & Co. KG, Herborn (DE)

( * ) Notice: Subject to any disclaimer, the term of this patent is extended or adjusted under 35 U.S.C. 154(b) by 133 days.

(21) Appl. No.: 13/996,201

(22) PCT Filed: Dec. 20, 2011

(86) PCT No.: PCT/EP2011/073362
§ 371 (c)(1),
(2), (4) Date: Jun. 20, 2013

(87) PCT Pub. No.: WO2012/084918
PCT Pub. Date: Jun. 28, 2012

(65) Prior Publication Data

US 2013/0280107 A1 Oct. 24, 2013

(30) Foreign Application Priority Data

Dec. 22, 2010 (DE) ..... 10 2010 061 494

(51) Int. Cl.
*B63J 4/00* (2006.01)
*F04D 7/04* (2006.01)
*F04D 9/04* (2006.01)

(52) U.S. Cl.
CPC ..... *B63J 4/006* (2013.01); *F04D 7/045* (2013.01); *F04D 9/04* (2013.01); *F04D 9/042* (2013.01)

(58) Field of Classification Search
CPC . F04D 7/045; F04D 9/04; F04D 9/042; F04D 13/12; F04D 25/16; F04D 25/163;
(Continued)

(56) References Cited

U.S. PATENT DOCUMENTS 1,475,994 A 12/1923 Havens
3,518,028 A 6/1970 Minick
(Continued)

FOREIGN PATENT DOCUMENTS

CH 171 805 9/1934
DE 712 351 10/1941
(Continued)

OTHER PUBLICATIONS

DE102008057849 translation; May 2010; Kreft, Susanne; Cutting device for e.g. sewage pump, has cutting body coaxially surrounded by fixed cutting ring, where annular gap between cutting body and ring decreases in its width from inlet aperture to rotor in opening region close to pump inlet.*

*Primary Examiner* — Kenneth J Hansen
(74) *Attorney, Agent, or Firm* — Clark & Brody

(57) ABSTRACT

The invention relates to a pump device for operating vacuum drainage systems and for pumping sewage, in particular on watercrafts. This pump device comprises a drive device having a drive shaft that comprises a first shaft end and a second shaft end and can be rotated by means of the drive device. The pump device further comprises a centrifugal pump which has at least one impeller that is connected in a torque-proof manner to the drive shaft in the region of the first shaft end.

19 Claims, 4 Drawing Sheets

(58) Field of Classification Search
CPC ..... F04D 13/16; F04C 11/005; F04C 23/005; B63J 4/006
USPC ..... 241/46.06, 46.08
See application file for complete search history.

(56) References Cited

U.S. PATENT DOCUMENTS 3,650,481 A * 3/1972 Conery et al. ..... 241/46.11
3,726,486 A * 4/1973 Smith ..... B02C 18/0092 241/244
4,123,201 A * 10/1978 Andriulis ..... 417/204
4,129,402 A * 12/1978 Eberhardt ..... 415/56.1
4,657,487 A * 4/1987 Schonwald et al. ..... 417/68
4,819,279 A * 4/1989 Sigler et al. ..... 4/300
4,842,479 A * 6/1989 Dorsch ..... F04D 7/045 415/121.1
6,315,524 B1 * 11/2001 Muhs et al. ..... 417/199.2
6,551,054 B1 4/2003 Peltonen et al.
7,179,062 B1 * 2/2007 Drevitson et al. ..... 417/234
2004/0120828 A1 6/2004 Muhs
2005/0016588 A1 * 1/2005 Shimizu et al. ..... 137/205
2008/0089777 A1 * 4/2008 Lang ..... 415/56.1
2009/0067992 A1 * 3/2009 Keener ..... F04D 29/2288 415/121.1

FOREIGN PATENT DOCUMENTS

DE 33 37 224 5/1985
DE 44 23 150 1/1996
DE 195 43 916 5/1996
DE 38 42 349 6/1998
DE 198 34 815 2/2000
DE 697 21 722 3/2004
DE 690 09 738 9/2005
DE 102008057849 * 5/2010 ..... F04C 13/00
NL 1 022 109 6/2004

* cited by examiner

PUMP DEVICE

The invention relates to a pump device for operating vacuum drainage systems and for pumping sewage, in particular on watercrafts such as, e.g., ships.

Such pump devices are in principle well known and are used, e.g., for operating drainage systems on watercrafts. Such drainage systems serve for disposing of sewage accumulating in closed systems on ships. Disposal can take place into a collection tank, a downstream treatment plant and also out of the closed system, e.g., into the environment. Also, such drainage systems can have interfaces via which drainage, thus discharge of the sewage can be carried out in the harbor into the sewage system thereof. Similar systems are also used for land-based plants.

Due to the construction of watercrafts, the floor of the ship inevitably forms the lowest point, by which means the use of conventional drainage systems is possible only to a limited extent. Furthermore, due to the movement of the watercraft, the use of conventional drainage systems is made difficult. For this reason, normally, vacuum drainage systems are used for draining watercrafts.

In the case of known drainage systems it is to be considered that the fluid to be pumped, thus the sewage, is a fluid that can contain a multiplicity of different solids. The consequence of this is that exclusively very robust pumps have to be used and that in particular vacuum drainage as used, for example, in aircraft lavatories, can only be carried out with difficulties.

Filigree pumps involve the risk of getting damaged due to solids in the sewage and of clogging up, or even of failing completely.

The pump devices currently used for operating vacuum drainage systems on watercrafts take up a relatively large floor space and are in some cases difficult to adapt to changing conditions and are prone to clogging. Furthermore, in some cases they have a high weight and can be installed only with difficulties in small- and medium-sized watercrafts. Moreover, they usually do not have integrated cutting mechanisms for treating the sewage for downstream treating processes.

It is an object of the present invention to provide a pump device that eliminates the above-described disadvantages of known pump devices. In particular, it is an object of the present invention to provide a pump device by means of which a vacuum drainage system can be operated in a light and cost-effective and, moreover, compact construction.

A pump device according to the invention for operating vacuum drainage systems and for pumping sewage, in particular on watercrafts, has at least one drive device. This drive device is equipped with a drive shaft having a first shaft end and a second shaft end and can be rotated by means of the drive device. The drive device can involve, for example, a motor, in particular an electric motor. Such a motor can be drivingly connected to the drive shaft and, in particular, can use the latter in an integral manner as an output shaft for the motor power of the drive device. Of course, the drive device can also have gear stages in order to achieve an adjustment of the torque or the speed, or can be implemented with a directly mounted frequency converter which likewise allows controlling the speed.

Furthermore, in a pump device according to the invention, a centrifugal pump having at least one impeller is provided. This at least one impeller is fixedly connected to the drive shaft in the region of the first shaft end in a torque-proof manner. Thus, this means that the impeller is connected to the drive shaft in a torque-proof manner directly at the first shaft end or in close vicinity thereof. A torque-proof connection can be established, for example, through a press fit, thus, e.g., by shrinking the impeller onto the drive shaft. Also, other torque proof connections such as, for example, a tongue and groove joint between impeller and centrifugal shaft are also conceivable within the context of the present invention.

Moreover, a pump device according to the invention includes a vacuum pump having at least one rotor. The rotor is connected to the drive shaft in a torque-proof manner in the region of the second shaft end. In other words, with regard to the impeller of the centrifugal pump, the rotor is located on the opposite end of the drive shaft. Also, the rotor of the vacuum pump is connected to the drive shaft in a torque-proof manner. Here too, a connection can be established, e.g., via a press fit or by shrink fitting, or can be established via a tongue and groove joint.

The arrangement of the impeller and the rotor in the region of the respective shaft end of the drive shaft is to be understood such that rotor and impeller are located opposite with regard to the shaft ends of the drive shaft. The impeller and the rotor can be arranged at the actual end of the drive shaft or can be arranged on the drive shaft spaced apart from the end thereof. An arrangement of rotor and impeller together on one side of the shaft is also conceivable.

In a device according to the invention it is possible that the drive shaft is configured as one piece or multiple pieces. In particular, it is conceivable that for the impeller of the centrifugal pump and/or the rotor of the vacuum pump a separate component of the drive shaft is provided, which component is connected to the rest of the drive shaft in a torque-proof manner, wherein the drive shaft can serve at the same time as an output shaft of the electric motor. Thus, the drive shaft consists of individual drive shaft parts assembled via torque couplings. Such an embodiment has the advantage that standard electric motors can be used. Such standard electric motors that provide their driving power via an output shaft on two sides of the motor thus can be used cost-effectively for producing a device according to the invention.

A decisive advantage of the pump device according to the invention is that the centrifugal pump and also the vacuum pump can be driven with the same drive device. Accordingly, on the one hand, no additional drive is necessary for the vacuum pump and, on the other, no separate controller is necessary. In other words, controlling or regulating both pumps of the pump device is simplified in that only a single drive has to be provided and controlled.

Another advantage of a pump device according to the invention is that a particularly compact construction can be achieved. By arranging the vacuum pump, in particular the rotor thereof, and the centrifugal pump, in particular the impeller thereof, opposite to one another, the necessary overall installed size of the pump device is only insignificantly increased with respect to the overall installed size of the drive device. In principle, on both side of the drive device, the appropriate pump is attached so that the overall construction size stretches substantially the construction size of the drive device. A housing of the respective pump can advantageously correlate with the housing of the drive device and can in particular be fastened thereto. The overall system of the pump device thus can be produced in a particularly compact manner. Already existing receptacles for pump devices in already existing drainage systems can be equipped in this manner with a pump device according to the invention without the need of constructional changes.

Each of the two pumps has suitable ports so as to be connected to a drainage system. Thus, the vacuum pump of the pump device according to the invention is provided with a port on the suction side and a port on the pressure side. The port on the pressure side can advantageously be short so as to serve directly as ventilation of the vacuum pump. In order to ensure that no counterstroke back into the system of the vacuum pump can take place, the outlet on the pressure side or the inlet on the suction side of the vacuum pump can be secured with an overpressure valve (check valve) which enables only one direction of movement of the pumped fluid out of the vacuum pump. By using a check valve upstream or downstream of the vacuum pump, it is also ensured that the pipe system is not aerated during a standstill of the pump device.

The port on the suction side can be connected directly or indirectly to the drainage system. In particular an indirect connection via a buffer storage enables here a particularly advantageous support of the drainage by means of the generated vacuum. Depending on the embodiment of the drainage system, the ports of the vacuum pump can possibly be provided with adaptors so as to be adapted to the corresponding type of thread or flange connection of the drainage system.

The centrifugal pump is likewise provided with at least two ports. On the one hand, the centrifugal pump has a port on its pressure side, which port can discharge the pumped sewage. Discharging can be carried out into a closed channel system, a treatment plant and also into a collection tank, or out of the drainage system into the environment. The port on the pressure side of the centrifugal pump can also be understood as the outlet from the drainage system for the sewage. An additional check valve, which can be arranged above the pressure nozzle, prevents the pipe system from being bled through the centrifugal pump.

On the suction side, the centrifugal pump likewise has a port via which sewage can be sucked into the centrifugal pump.

According to different embodiments of the present invention, the suction side of the centrifugal pump can represent the direct or also the indirect connection to a drainage system which is to be operated with a pump device according to the invention. A direct connection of the centrifugal pump to a drainage system is in particular useful in the embodiment in which the vacuum pump is connected on the suction side via a buffer storage. In such an embodiment, the port of the suction side of centrifugal pump at the buffer storage lies below the port of the suction side of the vacuum pump and discharges sewage contained in the buffer storage. The buffer storage serves for separating the introduced air-sewage mixture and ensures that no sewage is sucked in by the vacuum pump. The sewage itself in the buffer storage serves as a decoupling fluid for the vacuum which is generated above the sewage in the buffer storage by the vacuum pump. When controlling the vacuum pump it is advantageously ensured that the level of the sewage in the buffer storage is above the suction-side port of the centrifugal pump and below the suction-side port of the vacuum pump. By using the check valve at the pressure nozzle of the centrifugal pumps it is prevented that the buffer tank is aerated through the centrifugal pump. Therefore, the buffer tank in such a system can also be completely emptied.

The above-described connections of the vacuum pump and the centrifugal pump, directly or indirectly via a buffer storage, thus form the fluid interfaces of the pump device to the drainage system.

It can be an advantage if in a pump device according to the invention a cutting device is provided that has at least one cutting means that is connected in a torque-proof manner to the drive shaft in the region of the first shaft end and upstream of the impeller. Thus, the cutting device serves for contacting the water before it enters the centrifugal pump. The rotating cutting means is likewise connected to the drive shaft in a torque-proof manner so that it rotates together with the latter. Thus, in summary, it can be said that in such an embodiment the rotatable cutting means, the impeller of the centrifugal pump and also the rotor of the vacuum pump rotate together with a substantially identical speed. Of course, it is conceivable that in the case that different speeds are preferred, a gear unit is provided between the drive device and the centrifugal pump and/or between the drive device and the vacuum pump, which gear unit, for example in the form of a planetary gear or a spur gear, enables changes in torque and thus in speed. Also, it is possible through such gear units to achieve a redirection of the torque, for example, for reversibly operating the cutting means for the purpose of cleaning.

A cutting device according to the invention is advantageous since in this manner the sewage can be pre-treated before it gets into the pump device, in particular into the impeller of the centrifugal pump. This mechanical pretreatment through the cutting device serves for comminuting the solids that float in the fluid phase of the sewage. The comminution has the advantage that the subsequent pipe diameters and also the design of the centrifugal pump can be based on the comminuted particles. Accordingly, smaller pipe diameters and also a more compact construction of the centrifugal pump are possible without having to accept frequent clogging of the centrifugal pump or the subsequent pipes. The cutting device thus serves for both comminuting the solids and also for filtering the solids. Furthermore, due to the comminution of the substances, a treatment of the sewage for subsequent treatment processes takes place. In particular, it is ensured through the cutting device that no solids above a certain grain size can get into the impeller of the centrifugal pump. When using the pump device for drainage systems on watercrafts, such solids can be, for example, organic waste or pieces of residual waste such as, for example, plastic foils, plastic parts, or the like. Depending on the situation of utilization of the drainage system, type and size of the solids are variable so that the cutting device is designed in an advantageous manner for a maximum load through such solids.

For a pump device according to the invention it can be advantageous if the cutting device involves at least one rotatable cutting means in the form a rotatable cutting knife. A rotatable cutting knife, for example, can be associated with the drive shaft in radial connection thereto, wherein the cutting edges of the cutting knife advantageously extend along the radial direction away from the drive shaft so that solid particles situated in the central region of the sewage flow are mechanically processed by the cutting knife. Also, the rotatable cutting knife can be arranged, for example, directly at the first shaft end of the drive shaft, thus on the shaft stub at this first shaft end. In this manner, the rotatable cutting knife, as it were, is arranged upstream of the drive shaft so that radial installation space can be saved.

In addition, it is advantageously possible that in a pump device according to the invention, the cutting device has at least one rotatable cutting means in the form of a rotatable cutting ring. Such a cutting ring can be arranged, for example, outside of a rotatable cutting knife with regard to the radial direction of the drive shaft. Said cutting ring allows the sewage flow to pass the cutting device while the solids in the sewage flow are mechanically processed at the same time. Also, in addition to its cutting function, the cutting ring acts as a filter for the maximum permitted size of the solids downstream of the cutting device. Accordingly, the cutting device is in particular capable of mechanically processing solid particles in the sewage flow, which particles are present in the current of the radially outer region of the sewage flow. Also, it is possible that the cutting knife does not allow direct passing, but that passing is possible for the sewage flow only by passing the rotatable cutting ring. Thus, it is possible in this manner that the cutting knife represents a pretreatment, and the cutting ring represents an after-treatment of the sewage. When combining a rotatable cutting knife and a rotatable cutting ring with one another, the rotatable cutting knife is advantageously arranged upstream of the rotatable cutting ring in the axial direction of the drive shaft with regard to the flow direction of the sewage. In this manner, the cutting knife can be understood as the first stage of mechanically processing the sewage and the cutting ring can be understood as the second stage of this mechanical processing. Thus, the cutting knife can serve for comminuting the coarsest solids such that they do not hinder the cutting ring during its mechanical processing, in particular do not clog the cutting ring.

When using a cutting device according to the invention it can be advantageous if said device is configured in such a manner that the passing material is comminuted to a grain size of smaller than or equal to 4 mm to 8 mm. In particular, as already described above, the cutting ring is implemented as second stage of the mechanical processing and is configured in an interchangeable manner so that by selecting a suitable cutting ring in a modular construction, a maximum grain size can be set for the passing material, thus for the solid particles in the sewage flow, of smaller than or equal to 4 mm or smaller than or equal to 8 mm. After this, depending on the selected cutting ring, it is possible to configure the subsequent dimensions of the pipes. Conversely, it is also possible that in the case of already existing piping and a known diameter of an existing drainage system, a corresponding adaptation of the pump device according to the invention to the existing drainage system takes place via the cutting ring. Through the modular structure of the cutting device it is ensured in this manner that such a flexible usage is possible in a particularly cost-effective manner. Of course, the rotatable cutting knife can also be configured interchangeably. In particular, it is possible in this manner to use in the pump device a cutting knife which is adapted to the stationary cutting ring that is used. The flexibility of a pump device according to the invention is further increased through such a configuration. Also, it can be an advantage if in a pump device according to the invention, the vacuum pump is configured as a rotary vane pump. In such a rotary vane pump, the rotor of the vacuum pump is provided with rotary vanes which are movable as vanes in the radial direction of the rotor and are mounted therein. Moreover, there are spring elements in the rotor which push the respective rotary vanes radially outward. The rotor itself and thus also the drive shaft of the drive device on which the rotor is fastened in a torque-proof manner are arranged eccentrically in the housing of the vacuum pump. In this manner, the pins of the vacuum pump, in particular of the rotor, move radially outward and inward when they move along the housing of the vacuum pump. Through the rotation and the radial movement of the pins, which result in a variation of the pump chambers defined by said pins, the vacuum pump is operated and pumping of gas is achieved. Advantageously, in such an embodiment, a check valve is provided which prevents oil from flowing back from the vacuum pump. In particular, the sewage in the drainage system is to be protected against such a contamination. Advantageously, circulating oil lubrication takes place via an oil separator and an oil tank, wherein the separated oil is automatically fed back to the vacuum pump.

A gas ballast valve serves for the purpose that smaller amounts of vapor sucked from the suction side into the vacuum pump do not condense on the rotor or on other places inside the pump.

Using a rotary vane pump for a pump device according to the invention has the advantage that it can be implemented in a cost-effective manner and, moreover, the operation thereof includes a relatively small loss in torque. It is possible here that the vacuum pump in a pump device according to the invention is coupled directly, in particular without gear unit, to the drive device. The vacuum pump, in particular the rotor thereof, thus rotates in such an embodiment with the same speed, as does the impeller of the centrifugal pump.

Also, it is advantageous if in a pump device according to the invention the rotor of the vacuum pump is connected in a torque-proof manner to the drive shaft in the region of the second shaft end via a switchable coupling. Of course, such a coupling can also be arranged between the connection of the impeller of the centrifugal pump to the first shaft end of the drive shaft. Using a coupling for the torque-proof connection between the rotor of the vacuum pump and/or the impeller of the centrifugal pump has the advantage that the respective pump can be actively selected and/or switched off or on via the switchable coupling. If now during the use of a pump device according to the invention the support of only one of the two pumps is desired, this is readily possible by connecting the corresponding coupling. Such couplings can be connected electromechanically or pneumatically. Manually operated couplings, which are operated purely mechanically, are also conceivable within the context of the present invention. In particular by providing a coupling for the vacuum pump, thus, the pump device according to the invention can be used in a traditional mode of operation, thus exclusively using a centrifugal pump. For special operational situations, the vacuum pump can be connected without the need of a structural intervention in the pump device.

Another advantage is if in a pump device according to the invention, the vacuum pump is provided on its suction side with a filter. This filter is configured here in such a manner that solids having a grain size of greater than one mm cannot get into the vacuum pump. Such a filter can be equipped, for example, with a net, the mesh size of which determines the maximum diameter of particles that may pass this filter. This ensures that the vacuum pump is protected against damage caused by such solids. This is an advantage in particular when using the vacuum pump in the pump device according to the invention because it is not foreseeable which kind of solids are contained in the fluid to be pumped, thus in the sewage. By using a filter, on the one hand, the desired vacuum power can be provided on the suction side of the vacuum pump and, on the other, the vacuum pump itself, in particular the rotor thereof, can be sufficiently protected against damage caused by the solids. Advantageously, the filter is also designed for preventing not only solids but also fluids from penetrating into the vacuum pump. Such an embodiment is advantageous in particular in the case of a direct connection of the vacuum pump to a drainage system.

Furthermore, an upstream condensate separator is possible so as to prevent that water droplets or condensate from the suction line can get into the vacuum pump.

Furthermore it is advantageous if in a pump device according to the invention, the pump device is connected on its pressure side to a collection tank. This is an advantage in particular when using pump devices according to the invention on watercrafts since draining, thus discharge of the sewage into the environment, in particular into the surrounding water, is not desirable or is even forbidden by law. For such situations, a collection tank can be used which collects the sewage for operation in the closed system, and which is emptied at a time when the system is connected again to a sewer system, for example, when the watercraft is in a harbor. Thus, the collection tank offers the possibility to operate a drainage system on a watercraft, at least temporarily, as a substantially closed system by means of a pump device according to the invention. When using a collection tank, it is advantageous if the centrifugal pump is connected to the collection tank in such a manner that the centrifugal pump can be operated in both directions. Through appropriate piping and multiple connections on pressure side and suction side of the centrifugal pump it is possible in this manner to use the centrifugal pump not only for drainage into the collection tank, but also for drainage out of the collection tank for emptying the same into a suitably connected sewer system. This multi-functionality or multi-usage of the centrifugal pump of the pump device simplifies the structure of the system and, in addition, reduces the costs of a pump device according to the invention.

Another advantage is given if in a pump device according to the invention a cleaning opening is arranged on the suction side of the pump device, which cleaning opening is reversibly closed with a cleaning opening cover. Such a cleaning opening is a great advantage in particular due to the fact that the fluid to be pumped is sewage that can contain solids, the nature, shape and size of which are not foreseeable. Due to the reversible closure with a cleaning opening cover, an inspection of the region of the suction side of the pump device, thus in particular of the suction side of the centrifugal pump and/or the suction side of the vacuum pump can be carried out through this cleaning opening. If an inspection of the centrifugal pump and also of the vacuum pump is desired, it is advantageous if corresponding cleaning openings are provided directly before each of the two pumps. In particular useful is a cleaning opening in the region of the suction side of the centrifugal pump and, when using a cutting device, a cleaning opening before the latter is also useful. In the case of clogging of the centrifugal pump or damage to the cutting device caused by solids in the sewage to be pumped, it is possible in a particularly simple manner to provide access to the blocking solids or to the cutting device so as to exchange the latter or a portion thereof. In this manner, maintenance of a pump device according to the invention is simplified, and consequently, the costs resulting from blockages of the centrifugal pump or the cutting device are significantly reduced. Also, the downtime in the event of damage is reduced by the possibility of accelerated repair through the cleaning opening.

Likewise, it is advantageous if a buffer storage is provided for the pump device according to the invention, which buffer storage is kept under vacuum by means of the vacuum pump, and from which sewage can be pumped out by means of the centrifugal pump. Thus, the buffer storage separates a vacuum circuit from a sewage circuit so that the vacuum pump keeps the buffer storage under vacuum with a low probability that the vacuum pump is affected by inflowing sewage. The buffer storage, in turn, with the vacuum generated therein, is in contact on its connection side with the drainage system.

If sewage to be drained accumulates in the drainage system, the sewage is sucked into the buffer storage due to the vacuum therein. A slope within the drainage system is not necessary since the vacuum is sufficient to suck the respective sewage into the buffer storage. Once a certain filling height in the buffer storage is reached, the sewage contained therein is pumped out. For this, the centrifugal pump is used. The port of the suction side of the centrifugal pump therefore advantageously lies below the port of the vacuum pump on the suction side with regard to the sewage level inside the buffer storage. In this manner, the suction side of the centrifugal pump is constantly below the sewage level while the suction side of the port of the vacuum pump is constantly above the sewage level in the buffer storage. If now the buffer storage is emptied, the centrifugal pump and in particular also the cutting device are used. In such an embodiment it is advantageous if the one or the other pump can be selected by means of a coupling between the vacuum pump and the drive device or a coupling between the centrifugal pump and the drive device. Out of the centrifugal pump, the sewage from the buffer storage is fed into a collection tank, into a sewer system, or is disposed into the environment.

Another subject matter of the present invention is a drainage device on a watercraft, comprising a pump device according to the invention. Using a pump device according to the invention for a drainage device on a watercraft has the above-illustrated advantages of a pump device according to the invention.

The present invention is explained in more detail with reference to the accompanying drawing figures. The terms "left", "right", "above" and "below" used here refer to an alignment of the drawing figures with human readable reference numbers. In the figures.

Figure 1:
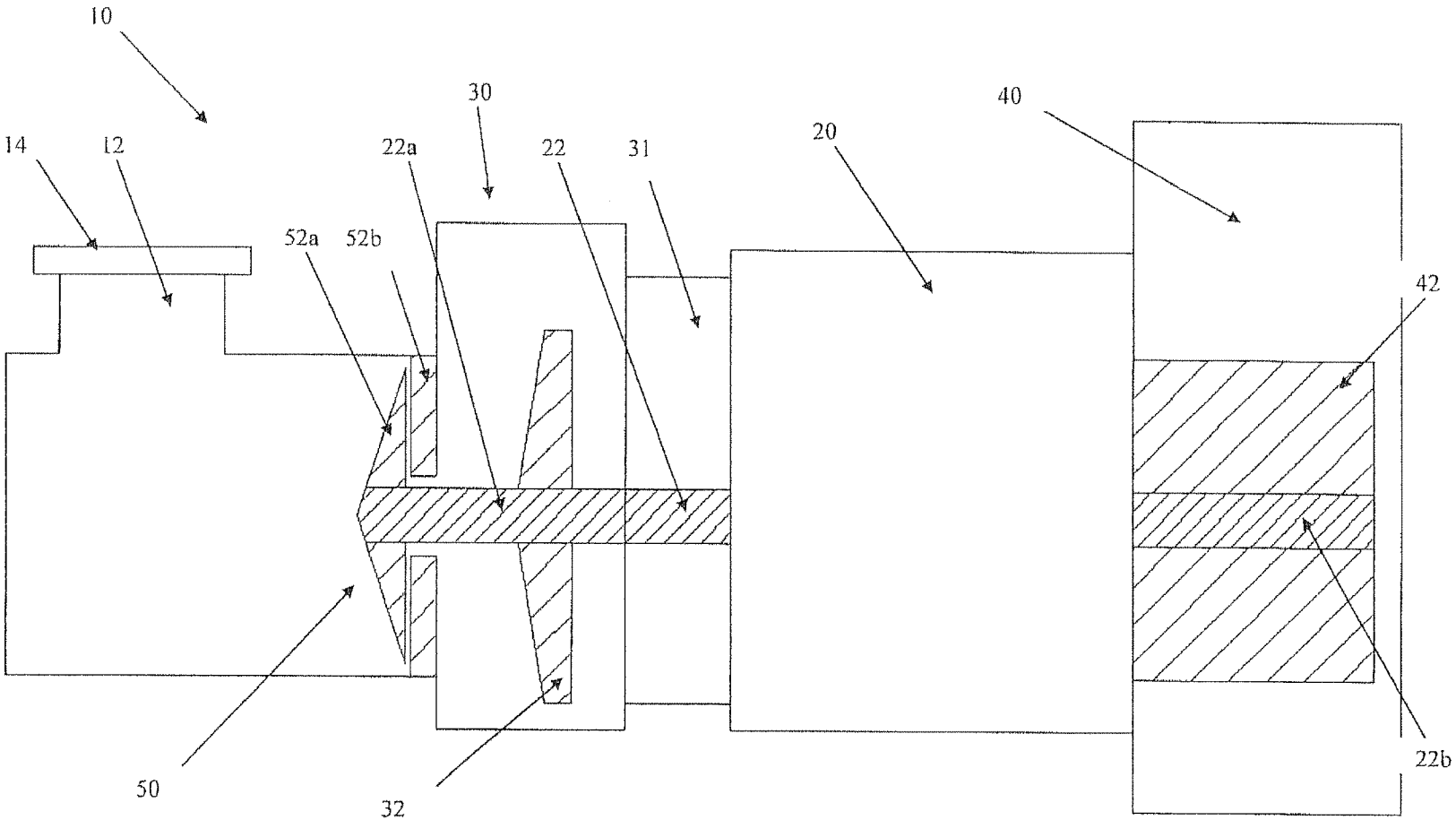
FIG. 1 shows a schematic cross-sectional illustration of an embodiment of the present invention.

FIG. 1 clearly shows the compact construction of a pump device 10 according to the invention. The pump device 10 according to the invention has a drive device 20 as the central component. In this embodiment, the drive device 20 is configured, for example, as an electric motor. The output shaft of the electric motor forms at the same time the drive shaft 22 of the pump device 10 so that the drive device provides the torque necessary for operating the pump device 10.

The drive shaft 22 of the drive device 20 protrudes from the drive device 20 from both sides thereof. In this manner, the two shaft ends 22*a* as the first shaft end and 22*b* as the second shaft end become visible and are provided to be utilized for the torque provided by the drive device 22 at these two shaft ends 22*a* and 22*b*. The impeller 32 of a centrifugal pump 30 is arranged at the first shaft end 22*a* of the drive shaft 22 in the region of said shaft end and is connected to the drive shaft 22 in a torque-proof manner. Likewise, a cutting device 50 is connected in a torque-proof manner to the drive shaft 22 in the region of the first shaft end 22*a* of the drive shaft 22. If a torque is transmitted to the drive shaft 20, the impeller 32 of the centrifugal pump 30 and also the cutting device 50 and the rotor 42 of the vacuum pump 40 rotate.

The cutting device 50 has a rotatable cutting knife 52 which is divided into a rotatable cutting knife 52*a* and a stationary cutting ring 52*b*. The stationary cutting ring 52*b* lies outside of the rotatable cutting knife 52*a* with regard to the radial direction, and lies behind the rotatable cutting knife 52*a* with regard to the axial direction of the drive shaft 22. By selecting an adequate cutting ring 52*b*, the maximum value for the grain sizes of solid particles allowed to pass through can be set.

Furthermore, upstream of the cutting device 50, a cleaning opening 12 is provided. This cleaning opening 12 is closed with a cleaning opening cover 14 which can be reversibly closed. If now clogging or reduced output of the centrifugal pump 30 is detected, an inspection of the centrifugal pump 30 and also of the cutting device 50 can be carried out via the cleaning opening 50. If it is detected during this inspection that solids have deposited in this region, these solids can be removed through the cleaning opening 12 without any problem so that the continued operation of the cutting device 50 and also the centrifugal pump 30 is ensured. Between the centrifugal pump and the drive device there is a dry run protection 31 for protecting the mechanical seal in the case of a dry run of the centrifugal pump.

The rotor 42 of a vacuum pump 40 is fixed at the second shaft end 22*b* of the drive shaft 22. As is schematically shown in FIG. 1, the vacuum pump 40 is preferably a rotary vane pump, wherein the rotor 42 is arranged eccentrically in the housing of the vacuum pump 40. Not shown are the individual design features of the rotor 42, in particular the necessary rotary vanes and the spring elements for moving the respective rotary vane in the radial direction, and how they rest against the housing of the vacuum pump 40. The rotor 42 is also connected to the drive shaft 22 in a torque-proof manner so that in the embodiment of FIG. 1, the rotor 42, the cutting device 50 and the impeller 32 of the centrifugal pump 30 all rotate with the identical speed of the drive device 20. With regard to controlling the pump device 10 of the present invention, thus, only a signal and power supply is needed for the drive device 20 which, in the same manner, drives all three components, namely the rotor 42 of the vacuum pump 40, the impeller 32 of the centrifugal pump 30 and also the cutting means 52 of the cutting device 50 with the same speed.

Figure 2:
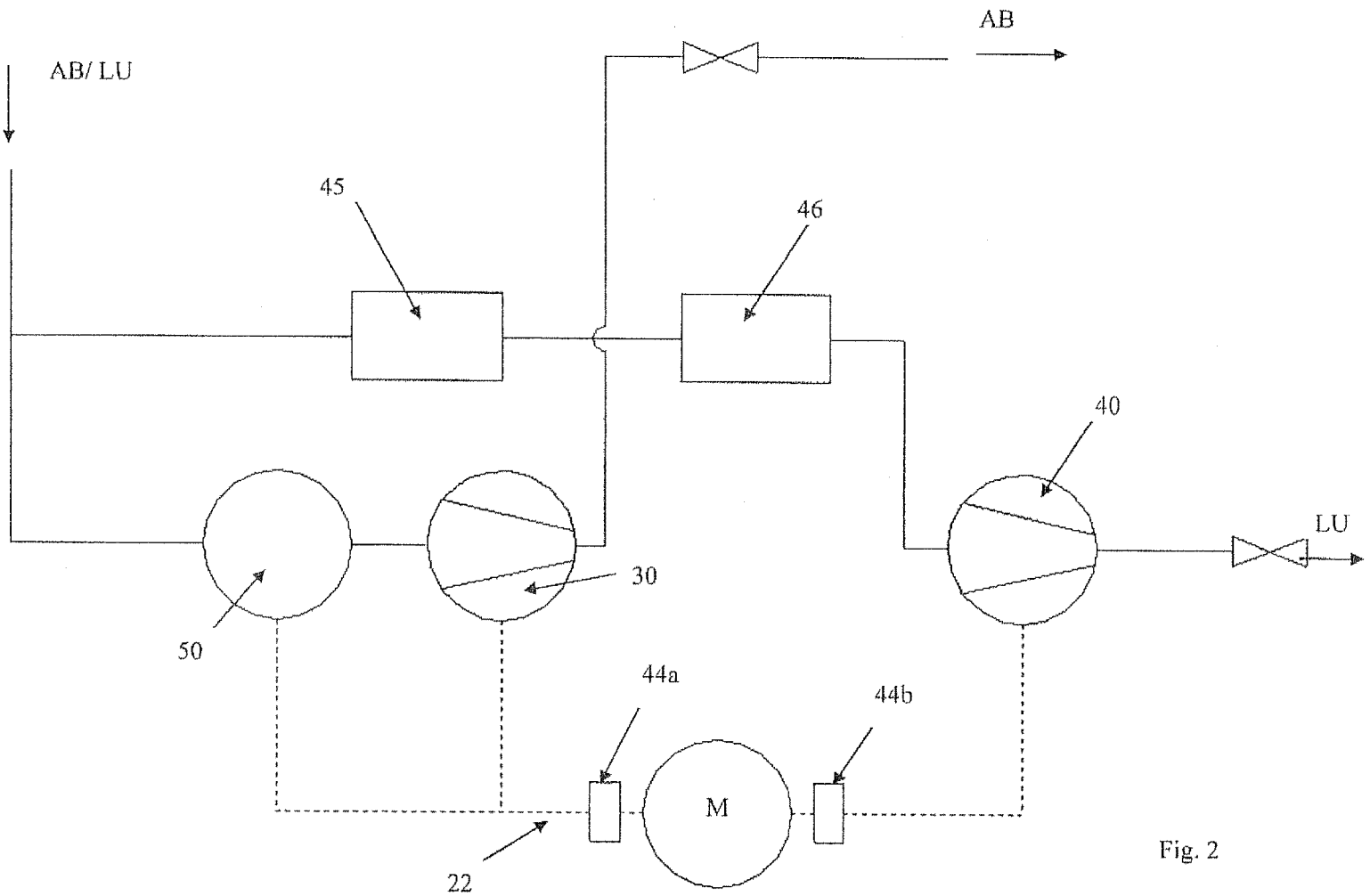
FIG. 2 shows a schematic illustration of a flow diagram of an embodiment of the present invention.

FIG. 2 schematically illustrates a flow diagram using a pump device 10 according to the invention. The drive shaft 22 is illustrated here in dashed lines according to its functionality. A drive device 20, here likewise implemented as a motor, in particular as an electric motor, is connected in a torque-transmitting manner to the vacuum pump 40 and also to the centrifugal pump 30 and the cutting device 50 via the drive shaft 22. In other words, the drive device 20 drives all three components together, thus the cutting device 50, the centrifugal pump 30 and the vacuum pump 40. The centrifugal pump 30 and the cutting device 50 are arranged here in the region of a first shaft end 22*a*, and the vacuum pump 40 is arranged on an opposite second shaft end 22*b* of the drive shaft 22. The pump device 10 can be implemented as illustrated in FIG. 1, for example.

By means of the vacuum pump 40, a vacuum is generated in the connected pipe system until a stable vacuum is reached. After reaching the desired vacuum in the pipe system, the pump device switches off and the system is ready for operation. Through the discharge points (toilets, showers and drains), an air-sewage mixture LU/AB is discharged in intervals into the pipe system, which mixture accumulates before the suction opening of the centrifugal pump. When the sewage level before the centrifugal pump has reached a predefined height, or the vacuum in the system is no longer sufficient to constantly operate the system, the pump device switches on again. The sewage before the centrifugal pump is comminuted and discharged, and the air taken in is removed by the vacuum pump until a stable vacuum is established again so as to reliably operate the connected vacuum drainage system. Furthermore, upstream of the vacuum pump 40 there are a filter 46 and a condensate separator 45 which prevent that solid particles, water droplets or condensate above a certain size, in particular greater than 1 mm, can get into the vacuum pump 40.

In order to be able to drive or switch off the vacuum pump in a specific manner, a coupling 44*b* is provided in the drive shaft 22. Through the coupling 44*b* it is possible to switch on or also to switch off the torque transmission from the drive device 20 to the vacuum pump 40. Thus, the vacuum pump 40 becomes switchable, thereby further increasing the flexibility of use of a pump device 10 according to the invention. Furthermore, there is a coupling 44*a* in the drive shaft 22 between drive and centrifugal pumps.

Figure 3:
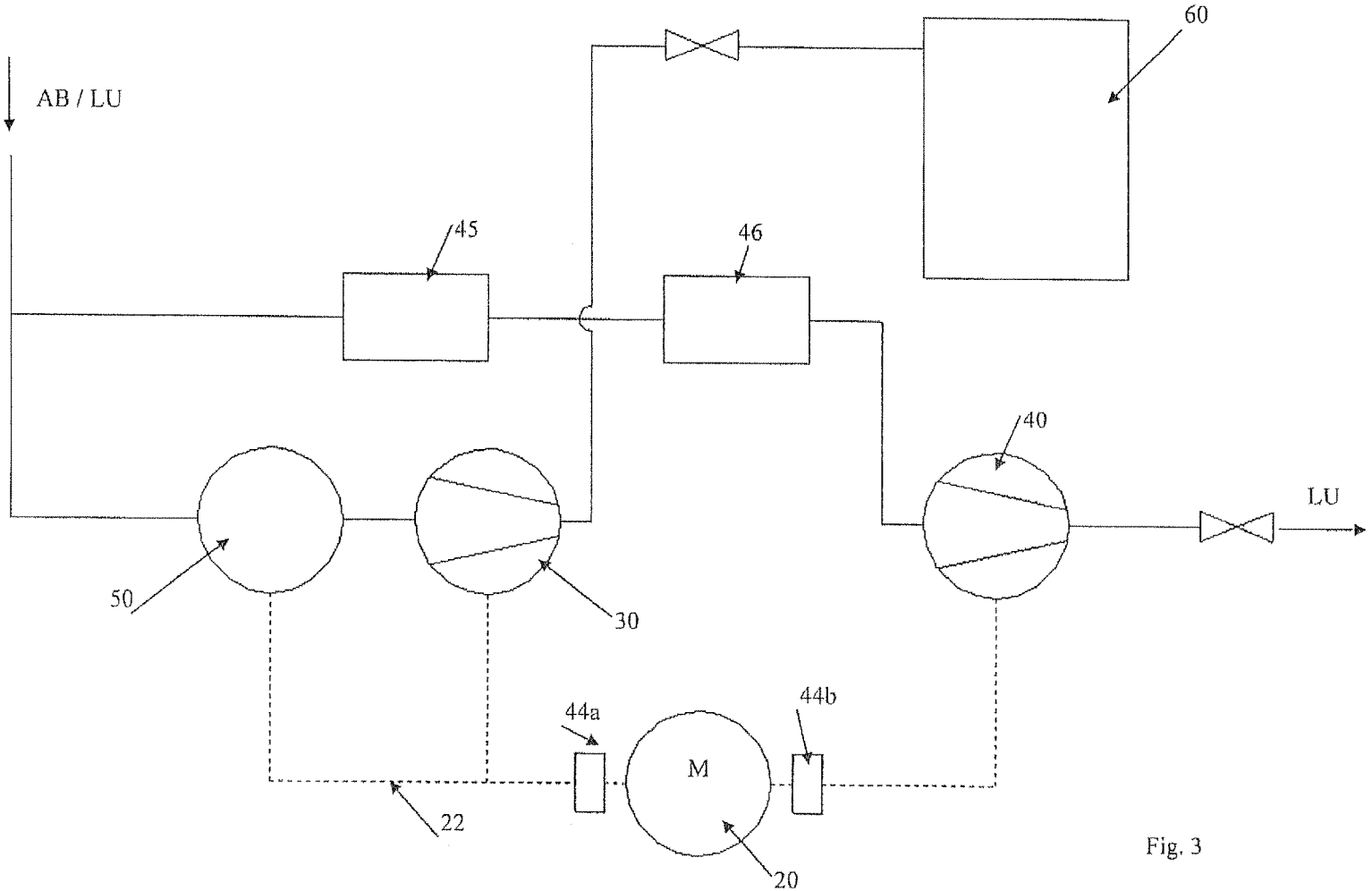
FIG. 3 shows a schematic illustration of a further embodiment of the present invention.

FIG. 3 shows a variation of the embodiment of FIG. 2. The components used therein and having the same effect are designated with the same reference numbers, for which reason a detailed description thereof is omitted. Rather, only the differences of the two embodiments are explained below.

In contrast to FIG. 2, a plurality of differences can be seen in the embodiment of FIG. 3. Firstly, the sewage AB is not pumped into the surroundings or a connected sewer system; rather, a collection tank 60 is provided into which the discharge takes place. The collection tank 60 is dimensioned here in such a manner that, at least temporarily, an isolated operation of the pump device 10 in a drainage system can be used. The collection tank can be an already existing integral part of an existing drainage system to which the pump device 10 according to the invention is connected.

Figure 4:
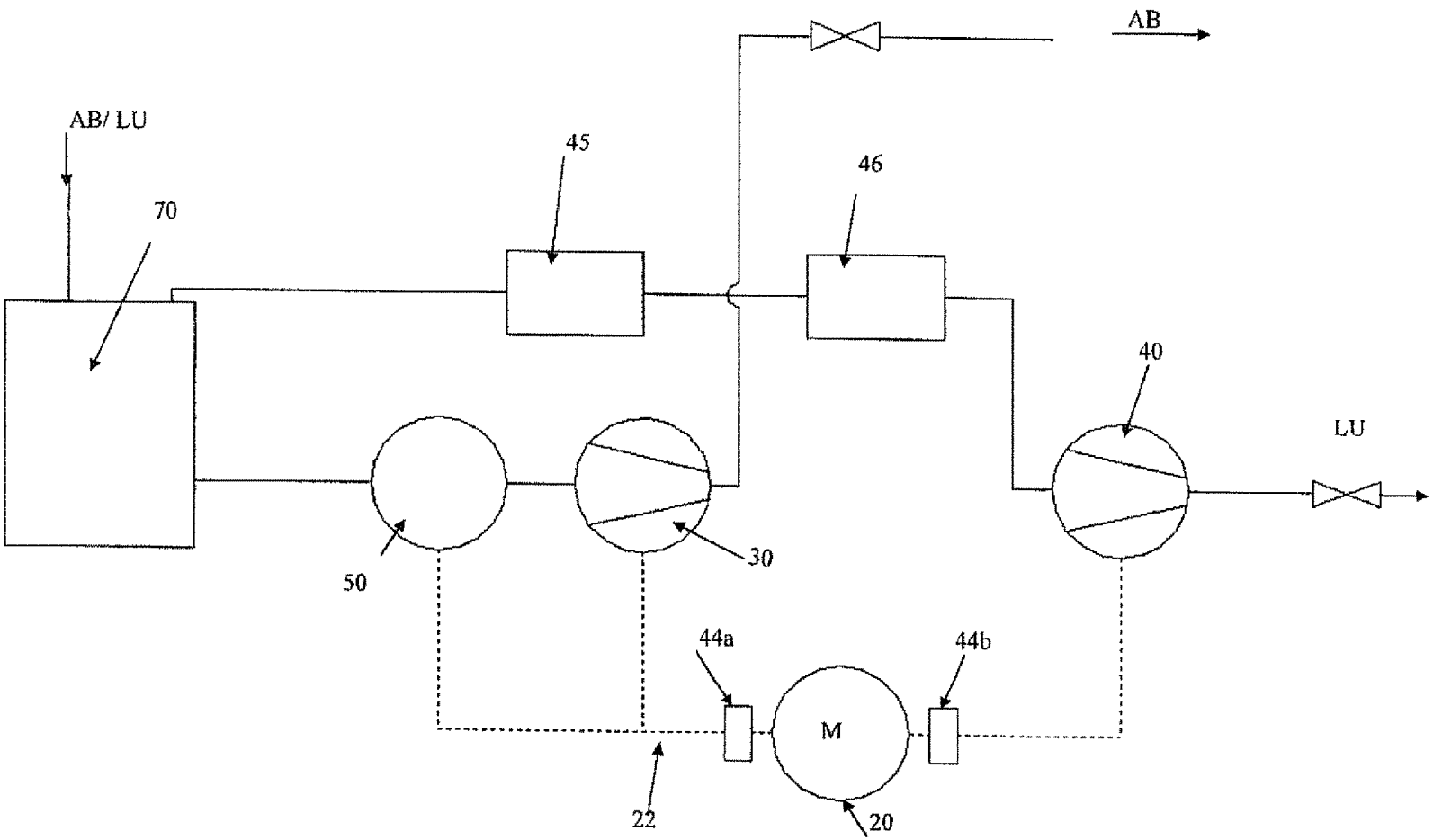
FIG. 4 shows a schematic illustration of a further embodiment of the present invention.

In FIG. 4, a further embodiment of a pump device according to the invention is schematically illustrated. Here too, identical reference numbers are used for identical components, which is the reason why an explanation thereof is not repeated here.

In contrast to the embodiments of FIG. 2 and FIG. 3, a buffer storage 70 is provided in this embodiment of FIG. 4. The buffer storage 70 is connected to the drainage system and can receive sewage AB therefrom. In order to receive the sewage from the drainage system, a vacuum is generated in the buffer storage 70. This vacuum is generated via the vacuum pump 40 which is driven via the drive device 20, in particular via the drive shaft 22. In other words, the buffer storage 70 is constantly kept under a vacuum so that in the case of sewage accumulating in the drainage system, the sewage, conveyed by the vacuum, can flow into the buffer storage 70. A slope for conveying the sewage AB is not necessary in this embodiment. Thus, a sewage level will arise in the buffer storage 70 which level advantageously lies below the port on the suction side of the vacuum pump 40. If the level rises over time in the buffer storage 70, discharge from the buffer storage 70 will be necessary once a certain sewage level is reached.

When the pumping device switches on, the centrifugal pump 30 is driven via the drive device 20, in particular the drive shaft 22 thereof, and discharging of sewage from the buffer storage 70 takes place. The sewage AB can be discharged into the environment or into a connected sewer system or into a storage tank as known from the embodiment of FIG. 3.

In this embodiment too, advantageously, a cutting device 50 is provided which is arranged upstream of the centrifugal pump 30. Accordingly, comminuting takes place only during the discharge from the buffer storage 70 so that the buffer storage still contains non-comminuted material. For example, this can be utilized such that coarse suspended solids deposit in the buffer storage during the detention time and cannot get into the subsequent circuit. In such an embodiment, the buffer storage 70 can be used as a primary rough treatment stage.

It goes without saying that the above illustrated embodiments are only examples. Of course, these examples can be freely combined with one another so that individual components can be combined into a new embodiment, provided that this is technically reasonable.

All features and advantages arising from the claims, the description and the drawing, including constructional details, spatial arrangements and methods steps, either in themselves or in many different combinations, can be essential for the invention.

REFERENCE LIST

10 Pump device
12 Cleaning opening
14 Cleaning opening cover
20 Drive device
22 Drive shaft
22*a* First shaft end
22*b* Second shaft end
30 Centrifugal pump
31 Dry run protection
32 Impeller
40 Vacuum pump
42 Rotor
44*a* Coupling
44*b* Coupling
45 Condensate separator
46 Filter
50 Cutting device
52 Rotatable cutting means
52*a* Rotatable cutting knife
52*b* Stationary cutting ring
60 Collection tank
70 Buffer storage
AB Sewage
LU Air
AB/LU Sewage-air mixture

The invention claimed is:

1. A system including a pump device (10) for operating a vacuum drainage systems and for pumping sewage, comprising a drive device (20) having a drive shaft (22) that comprises a first shaft end (22*a*) and a second shaft end (22*b*) and can be rotated by means of the drive device (20), a centrifugal pump (30) having at least one impeller (32) that is connected in a torque-proof manner to the drive shaft (22) in a region of the first shaft end (22*a*), a vacuum pump (40) having at least one rotor (42) that is connected in a torque-proof manner to the drive shaft (22) in a region of the second shaft end (22*b*), each of the centrifugal pump (30) and the vacuum pump (40) being connected to the drainage system, the vacuum pump (40) being provided with a first port on a suction side thereof and a second port on a pressure side thereof, the centrifugal pump (30) being provided with third and fourth ports, the first port of the vacuum pump (40) on the suction side thereof being connected indirectly to the drainage system via a buffer storage, the buffer storage (70) being kept under vacuum by the vacuum pump (40) and sewage can be pumped out of the buffer storage (70) by the centrifugal pump (30), and the third port of the centrifugal pump (30) being on a pressure side thereof and discharging the pumped sewage, the fourth port of the centrifugal pump (30) being on the suction side thereof and sucking sewage into the centrifugal pump (30), the centrifugal pump (30) being in direct connection to the drainage system by the fourth port on the suction side of centrifugal pump (30) and in fluid line connection to the buffer storage, the direct connection of the centrifugal pump to the drainage system below the first port of the suction side of the vacuum pump (40) allowing discharging sewage contained in the buffer storage, and a cutting device (50) having a rotatable cutting knife, wherein the rotatable cutting knife (52*a*) is connected in a torque-proof manner to the drive shaft (22) in the region of the first shaft end (22*a*) upstream of the impeller (32) and downstream of the buffer storage.

2. The system according to claim 1, characterized in that the cutting device (50) is configured to comminute material passing the cutting device into a grain size of smaller than or equal to 4 mm to 8 mm.

3. The system according to claim 1, characterized in that the vacuum pump (40) is designed as a rotary vane pump or a liquid ring vacuum pump.

4. The system according to claim 1, characterized in that the impeller (32) of the centrifugal pump is connected to the drive shaft (22) in a region of the shaft ends (22*a*, 22*b*) via switchable couplings (44*a* and 44*b*).

5. The system according to claim 1, characterized in that the vacuum pump (40) is provided on the suction side thereof with a filter (46) which prevents solids having a grain size of greater than 1 mm from getting into the vacuum pump (40).

6. The system according to claim 1, characterized in that the vacuum pump (40) is provided on the suction side thereof with a condensate separator (45) which prevents suctioned water droplets or condensate from a suction line and the upstream buffer storage (70) getting into the vacuum pump (40).

7. The system according to claim 1, characterized in that the pump device (10) is connected on the pressure side thereof to a collection tank (60).

8. The system according to claim 1, characterized in that a cleaning opening (12) is arranged on a suction side of the pump device (10), which cleaning opening is reversibly closed with a cleaning opening cover (14).

9. The system according to claim 1, characterized in that the buffer storage (70) is kept under vacuum by means of the vacuum pump (40), wherein sewage can be pumped out by means of the centrifugal pump (30).

10. The system according to claim 1, characterized in that the centrifugal pump (30) is provided with a dry run protection that protects a mechanical seal in a case of a dry run of the centrifugal pump (30).

11. The pump device system of claim 1, characterized in that the cutting device (50) has a stationary cutting ring that lies outside the rotatable cutting knife in a radial direction.

12. The system according to claim 1, characterized in that the cutting device (50) has a stationary cutting ring.

13. The system according to claim 12, characterized in that a maximum value for grain sizes of solid particles allowed to pass through is set by the stationary cutting ring.

14. The system according to claim 12, characterized in that the rotatable cutting knife (52*a*) is arranged upstream of the stationary cutting ring in an axial direction of the drive shaft (22) with regard to flow direction.

15. The system according to claim 12, characterized in that the stationary cutting ring has at least one cutting surface arranged cross-wise to an axial direction, over which the rotatable cutting knife is arranged to rotate.

16. The system according to claim 12, characterized in that an arrangement of the rotatable cutting knife and stationary cutting ring is such that the rotatable cutting knife functions as a first stage of mechanical processing and the stationary cutting ring functions as a second stage of mechanical processing.

17. The system according to claim 1, characterized in that the rotor (42) of the vacuum pump (40)is connected to the drive shaft (22) in a region of the shaft ends (22*a*, 22*b*) via switchable couplings (44*a* and 44*b*).

18. The system according to claim 1, wherein the buffer storage (70) has a first inlet in communication with the drainage system, a second inlet as a first portion on the suction inlet in communication with the vacuum pump (40) and an outlet as the fourth port on the suction side of the centrifugal pump (30), the buffer storage configured to allow a vacuum to be generated therein using the second inlet in order to draw sewage into the buffer storage from the first inlet, with the vacuum existing above the sewage drawn into the buffer storage, and the centrifugal pump is adapted for pumping sewage from the buffer storage via the outlet, including in instances where a level of sewage in the buffer storage reaches a level where sewage is sucked into the second inlet by the vacuum pump.

19. A drainage device on a watercraft, comprising a system and a pump device (10) according to claim 1.

* * * * *